US007093552B2

(12) United States Patent
Owen

(10) Patent No.: US 7,093,552 B2
(45) Date of Patent: Aug. 22, 2006

(54) ELECTRICALLY PRESSURIZED TORPEDO LAUNCH SYSTEM

(75) Inventor: Bryan Jeffrey Owen, Wraxall (GB)

(73) Assignee: Strachen & Henshaw Limited, Bristol (GB)

( * ) Notice: Subject to any disclaimer, the term of this patent is extended or adjusted under 35 U.S.C. 154(b) by 0 days.

(21) Appl. No.: 10/488,972

(22) PCT Filed: Sep. 10, 2002

(86) PCT No.: PCT/GB02/04108

§ 371 (c)(1),
(2), (4) Date: Oct. 8, 2004

(87) PCT Pub. No.: WO03/022675

PCT Pub. Date: Mar. 20, 2003

(65) Prior Publication Data

US 2005/0051076 A1 Mar. 10, 2005

(30) Foreign Application Priority Data

Sep. 10, 2001 (GB) ..... 0121839.5

(51) Int. Cl.
*B63G 8/32* (2006.01)
*F41F 3/08* (2006.01)

(52) U.S. Cl. ..... 114/238; 114/316; 114/319

(58) Field of Classification Search ..... 114/238, 114/239, 316–321; 89/1.809, 1.81; 124/56, 124/59, 60, 69–73; 42/1.14; 102/399
See application file for complete search history.

(56) References Cited

U.S. PATENT DOCUMENTS 4,848,210 A * 7/1989 Bissonnette ..... 89/1.81
5,200,572 A * 4/1993 Bissonnette et al. ..... 89/1.81
5,231,241 A * 7/1993 Bissonnette ..... 89/1.81
5,410,978 A * 5/1995 Waclawik et al. ..... 114/238
6,220,196 B1 4/2001 Escarrat
6,854,409 B1 * 2/2005 Galliano ..... 114/238
6,871,610 B1 * 3/2005 Galliano ..... 114/238

FOREIGN PATENT DOCUMENTS

FR 2 701 102 1/1993

OTHER PUBLICATIONS

Lefebvre, Paul J.; Rotary Electromagnetic Launcher (REML) System; Presented at the 2nd Annual Navy/Industry Partnership Conference; date unknown but believed to be Aug. 2001; pp. 1-7.

* cited by examiner

*Primary Examiner*—Ajay Vasudeva
(74) *Attorney, Agent, or Firm*—Stites & Harbison PLLC; Ross F. Hunt, Jr.

(57) ABSTRACT

A torpedo launch system for a marine vessel includes an impulse tank connected via a straight water inlet tube to an inlet orifice in an outer casing of the vessel. A launch tube extends through the impulse tank to the outer casing, and through a pressure hull of the vessel to terminate at a rear door. Pressurized water is provided to the launch tube to launch a torpedo by mounting an impeller in the impulse tank. The impeller pumps water into the impulse tank to develop a pressure which is transmitted to the launch tube when a valve in the impulse tank is opened. The impeller is driven by a motor which receives power via cables which pass through the pressure hull. The impulse tank and motor are between the outer casing and the pressure hull.

10 Claims, 3 Drawing Sheets

ELECTRICALLY PRESSURIZED TORPEDO LAUNCH SYSTEM

BACKGROUND OF THE INVENTION

1. Field of the Invention

The present invention relates to a payload launch system. It also relates to a marine vessel incorporating such a payload launch system. The payload may, for example, be a torpedo.

2. Description of the Prior Art

SUMMARY OF THE INVENTION

Many conventional torpedo launching systems use a water-pressurized impulse tank to force a torpedo out of its tube. An increasingly common method for launching torpedoes is the Air Turbine Pump (ATP) motivated Weapon Discharge System (WDS).

The operation of a conventional ATP positive discharge torpedo launch system in a submarine is illustrated in FIG. 1 of the accompanying drawings.

FIG. 1 is a schematic representation of a conventional torpedo launching system installed within the outer casing (1) and at the bow end of a submarine.

The outer casing has an aperture in the bow which can be covered by a bow shutter (2), and a water inlet orifice (3) aft of the bow. A pressure hull (4) lies within the outer casing, and encloses an inner chamber (5). The front bulkhead of the pressure hull and the outer casing of the submarine define an outer chamber (6). An impulse tank (7) is mounted fore of the pressure hull, in the outer chamber, and the front bulkhead of the pressure hull comprises the aft wall of the impulse tank. A torpedo tube (9), extends from the inner chamber (5), passing through the pressure hull and impulse tank and continues into the outer chamber, ending close to the outer casing bow shutter. The torpedo tube comprises a rear door (9) located in the inner chamber, through which a torpedo may be loaded into the tube; an inlet valve (10) located within the impulse tank, which forms the outlet of the impulse tank and serves to enable the flow of water from the impulse tank into the torpedo tube during firing; and an open end, closable with a bow cap (11), within the outer chamber, through which the torpedo will exit when discharged. The torpedo tube is installed at an attitude such that when a torpedo is discharged it will pass from the open end of the tube (when the bow cap is open), through the aperture in the outer casing (when the bow shutter (2) is open).

A pressurized air container (12), a programmable firing valve (PFV) (13), a control loop (14) and an operating console (15) are mounted inside the pressure hull.

The operating console (15) is connected to the control loop (14) which controls the PFV (13). The PFV regulates the airflow rate and pressure of air which is released from the pressurized air container (12).

High pressure air via the PFV drives an air turbine (16) mounted in the inner chamber. The air turbine is connected to a reduction gearbox (17). A drive shaft extends from the reduction gearbox through the pressure hull, hull integrity being maintained by a shaft-sealed hull penetration (18), exiting the front bulkhead at a point inside the impulse tank, where it connects to an impeller (19), also located within the impulse tank. A water inlet tube (20) connects the intake face of the impeller to the water inlet orifice (3) in the outer casing. The water inlet tube extends from the intake face of the impeller, passing through the wall of the impulse tank, bends through ninety degrees and connects to the water inlet orifice.

Note that in the known arrangement described above, the impulse tank is mounted on the pressure hull. Other arrangements are known in which it is spaced therefrom.

This air driven discharge system uses high-pressure air to drive the air turbine which in turn drives the impeller.

The impulse tank (7) acts as a manifold around one or more, usually several, torpedo tubes.

A firing sequence may begin with the bow cap, bow shutter and rear door being shut, and the torpedo tube drained. The rear door is then opened, the torpedo loaded and mechanically secured in the tube and the rear door closed. The tube is flooded and equalized with the fluid pressure outside the outer casing. The bow cap and bow shutter may then be opened and the torpedo released from the mechanical restraint. The inlet valve to the tube is opened and a PFV profile selected. High pressure air via the PFV drives the air turbine, which in turn drives the impeller to pressurizes the impulse tank, thereby developing water pressure within the impulse tank which is transmitted to the inside of the torpedo tube via the inlet valve. This water pressure forces the torpedo from its tube. The action of the impeller also has the effect of drawing additional water ("follow-up water") into the impulse tank via the water inlet tube.

Regulation of the air flow rate and pressure of air delivered to the air turbine provides control over the torpedo's discharge parameters.

Despite their widespread use and established efficacy, ATP systems have a number of drawbacks.

The ATP system utilizes high pressure air which is a secondary energy source within the submarine, hence requiring energy conversion in order to provide additional supplies. Moreover, after firing, the air released requires recompression.

Systems that rely on pneumatics and hydraulics have an additional maintenance burden leading to higher through life costs.

Systems that penetrate the pressure hull are often constrained with respect to their orientation by the structural integrity requirements of the penetration. This can result in additional constraint(s) on the discharge system, leading to a sub optimal solution for both the submarine and the discharge system.

SUMMARY OF THE INVENTION

It is therefore an aim of the present invention to address some of the drawbacks associated with existing launching systems.

At its most general, the present invention proposes that the impeller which forces sea water into the impulse tank, and which provides the over pressure which launches the payload, is driven by an electric motor and the impulse tank and the motor are between the inner and outer hull of the vessel.

Thus, the present invention may provide a marine vessel having a payload launch system, the vessel having an outer casing and an inner hull, the payload launch system having at least one payload launch tube, an impulse tank for fluid, the impulse tank having an inlet for entry of fluid into the impulse tank and an outer communicating with the torpedo tube, and an impeller inside the impulse tank for pressurizing fluid in the impulse tank so as to deliver pressurizing fluid to the tube via the outlet of the impulse tank to launch a payload from the tube;

wherein:

an electric motor unit is connected to the impeller to drive the impeller, with the impulse tank and the motor being between the inner hall and the casing.

By using an electric motor, the need for air compression, stowage and regulation is removed, increasing system efficiency and probably reducing the mass of the equipment and the volume within the pressure hull.

It should be noted that the action of the impeller in delivering pressurised fluid to the payload launch tube also normally has the effect of drawing additional fluid ("follow-up water") into the impulse tank via the inlet to the tank. Thus, the impulse tank is always full of fluid, maintaining a positive pressure behind the weapon throughout the launch.

It is possible for the electric motor to be located in the impulse tank itself, as this has the advantage that the orientation of the impeller within the tank is not constrained by the geometry of the pressure hull of the submarine. Of course, the electric motor needs a power supply, and that power supply will normally be located within the pressure hull, and indeed may be the normal electrical power supply of the submarine. However, since the motor is an electric one, only the appropriate cables need extend through the pressure hull from the power supply to the motor, and it is a relatively straight forward matter for appropriate static pressure seals to be provided. Thus, the present invention improves the integrity of the pressure hull.

Moreover, because the orientation of the impeller is not dependent on penetration of the pressure hull, it can be located so that its inlet faces directly the adjacent outer wall of the submarine. This permits a shorter water inlet tube from the outside of the submarine to the impeller tank to be used, and also means that the tube need not bend through e.g. 90° as in the arrangement of FIG. 1 previously described. The impeller then faces directly the water inlet orifice of the submarine. A further advantage of this arrangement is that, since the motor is immersed, it will be cooled by the fluid (normally water) in that tank.

However, it is not essential that the motor is in the impulse tank. It may be preferable for the motor to be located outside the impulse tank, but above it. Such a location has the advantage that it is then easy to access the motor, e.g. for maintenance and installation or removal. More particularly, when the submarine is at the surface, the space between the outer casing and the pressure hull is partially flooded, but with an air space above it. If the motor is then located in that air space, when the submarine floats, the motor is accessible for maintenance without the submarine having to be in dry dock. Of course, when the submarine is under water the air space is no longer present, and therefore the motor will be immersed, and therefore cooled as previously described.

With such an arrangement it is still possible for the appropriate cables to power the motor to extend through the pressure hull.

As has previously been mentioned with reference to FIG. 1, a submarine normally has an outer casing and a pressure hull within that outer casing. The torpedo tube normally extends through the impulse tank and the pressure hull to permit access to the torpedo tube from the interior of the pressure hull. The outlet from the impulse tank is normally formed by an inlet valve to the torpedo tube, so that the opening of that valve creates the outlet of the impulse tank.

In some conventional arrangements, such as the one illustrated in FIG. 1, and within the present invention, it is usual for the impulse tank to be mounted on an outer surface of the pressure hull. However, in the present invention, this is not necessary. As has been previously mentioned, only the power cables to the motor need pass through the pressure hull, and the motor may be mounted outside the pressure hull. As has been previously mentioned the motor may be inside the impulse tank, or at other locations between the outer casing and the pressure hull. However, in any such case, it is not necessary that the impulse tank be mounted on the outside of the pressure hull. It could be spaced therefrom. This latter arrangement has the advantage that the overpressure generated within the impulse tank during the launch of the torpedo is not transmitted directly to the pressure hull.

In the present invention, the impeller is preferably a centrifugal impeller, as in the known arrangements, and the electric motor is a high torque electric motor. Depending on the duty required of the system, there may or may not be a reduction gearbox between the motor and the impeller.

While the invention has been discussed above primarily in relation to a torpedo launch system, the present invention provides a submarine having such a torpedo launch system. In addition, the torpedo launch system in the present invention is not limited to use on submarines, and may be used on other marine vessels. Also, although it will be normal for the fluid used in the torpedo launch system of the present invention to be sea water, it is possible for other liquids to be used. Additionally the system may be scaled as appropriate to launch different payloads.

BRIEF DESCRIPTION OF THE DRAWINGS

Embodiments of the invention are described below, by way of example only, with respect to the accompanying drawings, in which.

DETAILED DESCRIPTION

Figure 1:
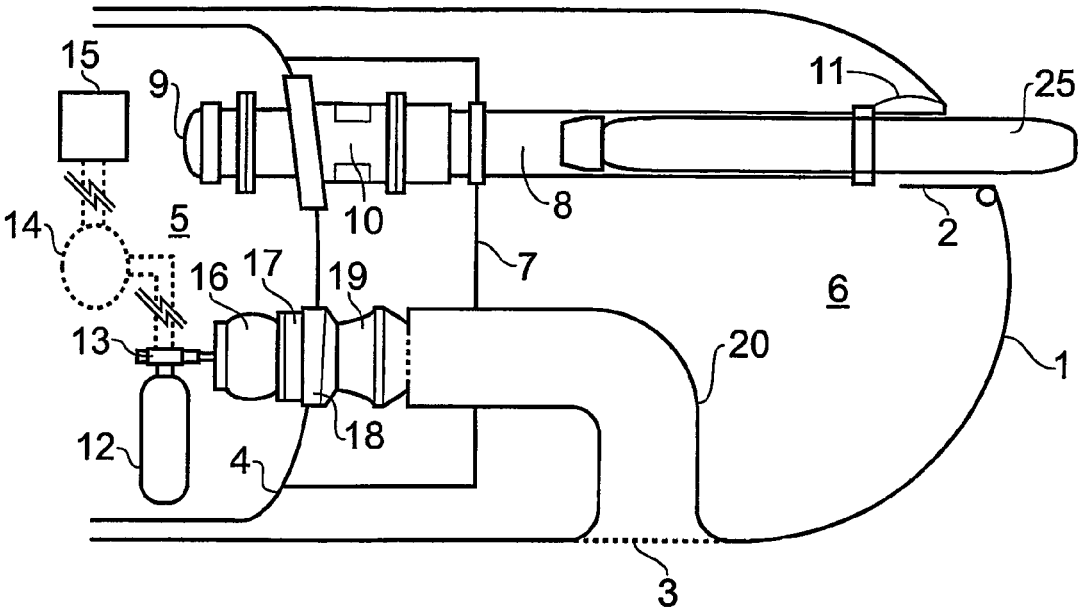
Fig. 1 (Prior Art)
FIG. 1 shows the layout of a conventional ATP Torpedo Launching System, and has already been discussed.
Figure 2:
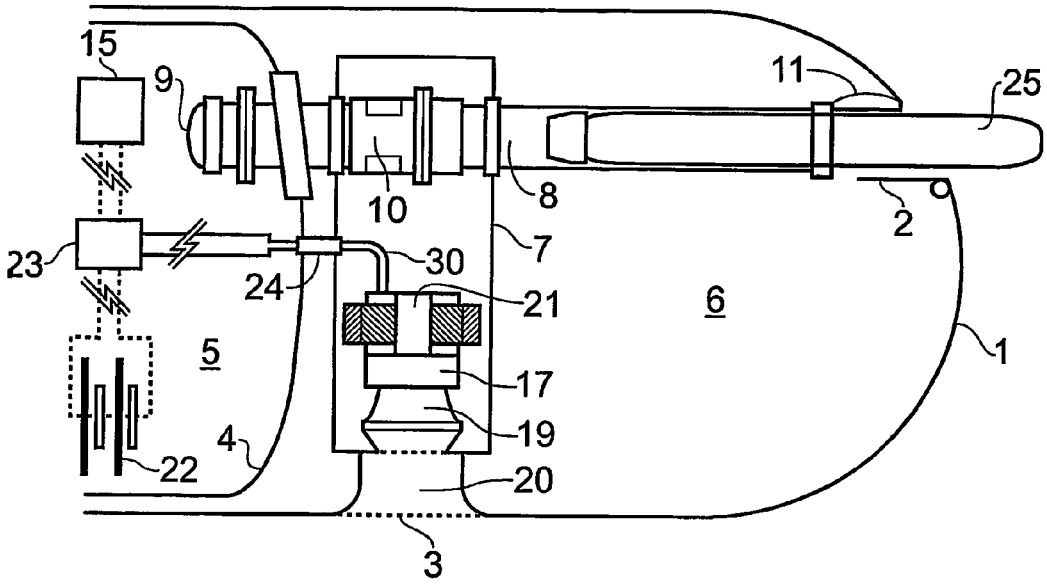
FIG. 2 shows the layout of an electrically driven Torpedo Launching System, being a first embodiment of the present invention.

FIG. 1 has already been discussed in relation to existing torpedo launching systems. FIG. 2, which represents a preferred embodiment of the present invention, retains the numbering system of FIG. 1. In the embodiments described herein the arrangement of the outer casing, pressure hull and torpedo tube remains unchanged from existing systems, and will not be described again. The same reference numerals are used to indicate corresponding parts.

In the preferred embodiment of the present invention a high torque electric motor unit (21) replaces the air turbine (16) present in existing ATP systems, and is similarly connected to a reduction gearbox and an impeller. The pressurised air container, programmable firing valve and control loop of existing torpedo launch systems are not present in this embodiment. The electric motor unit is powered from the submarine's main electrical supply (22). A motor controller (23), located in the inner chamber, regulates the current/voltage profile of the electrical supply to the motor. An operating console (15), also located in the inner chamber, facilitates the operation of the electric motor unit by transmitting electrical signals to the motor controller.

In the first embodiment of the present invention, the impulse tank (7) is installed within the outer chamber and is stood off from the pressure hull (4). The electric motor unit (21), a reduction gearbox (17) and an impeller (19) are mounted inside the outer chamber (6) and within the impulse tank (7). In this embodiment, the electric motor, reduction gearbox and impeller are mounted at an attitude such that the intake face of the impeller faces the water inlet orifice (3) in the outer casing of the submarine. Note that, by suitable selection of the speed of the motor unit (21) it may be possible to omit the reduction gearbox (17) and connect the impeller (19) directly to the motor unit (21). The motor controller (23) communicates electrically with the electric motor unit via power and sensor cables (30), which pass from the motor controller through the front bulkhead of the pressure hull in a cable gland (24) and continue through the aft wall of the impulse tank, into the interior of the impulse tank where they are connected to the electric motor unit. A straight water inlet tube (20) joins the intake face of the impeller tank to the water inlet orifice (3).

The torpedo launching system of this embodiment, represented in FIG. 2, is ready to fire when a torpedo or other weapon (25) is loaded in the torpedo tube (8), the rear door (9) is closed, and the inlet valve (10), bow cap (11) and bow shutter (2) are open. In this state the tube is flooded, with the torpedo mechanically restrained. Upon receipt of a firing signal from the torpedo operating console (15), the motor controller (23) activates a current/voltage profile which is derived from the main electrical supply (22). The electrical current passes through the cable gland (24) and powers the electric motor unit (21), which in turn drives the impeller (19). The impeller rapidly pressurizes the water in the impulse tank (7), this pressure surge passing via the inlet valve to the torpedo tube. The torpedo is released from the mechanical restraint and is forced out of the tube. Water expelled from the impulse tank during this pressure surge is replaced with water drawn from the water inlet tube (20) by the impeller. Once the weapon has cleared the submarine's outer casing (11) it is free to navigate under its own power.

Figure 3:
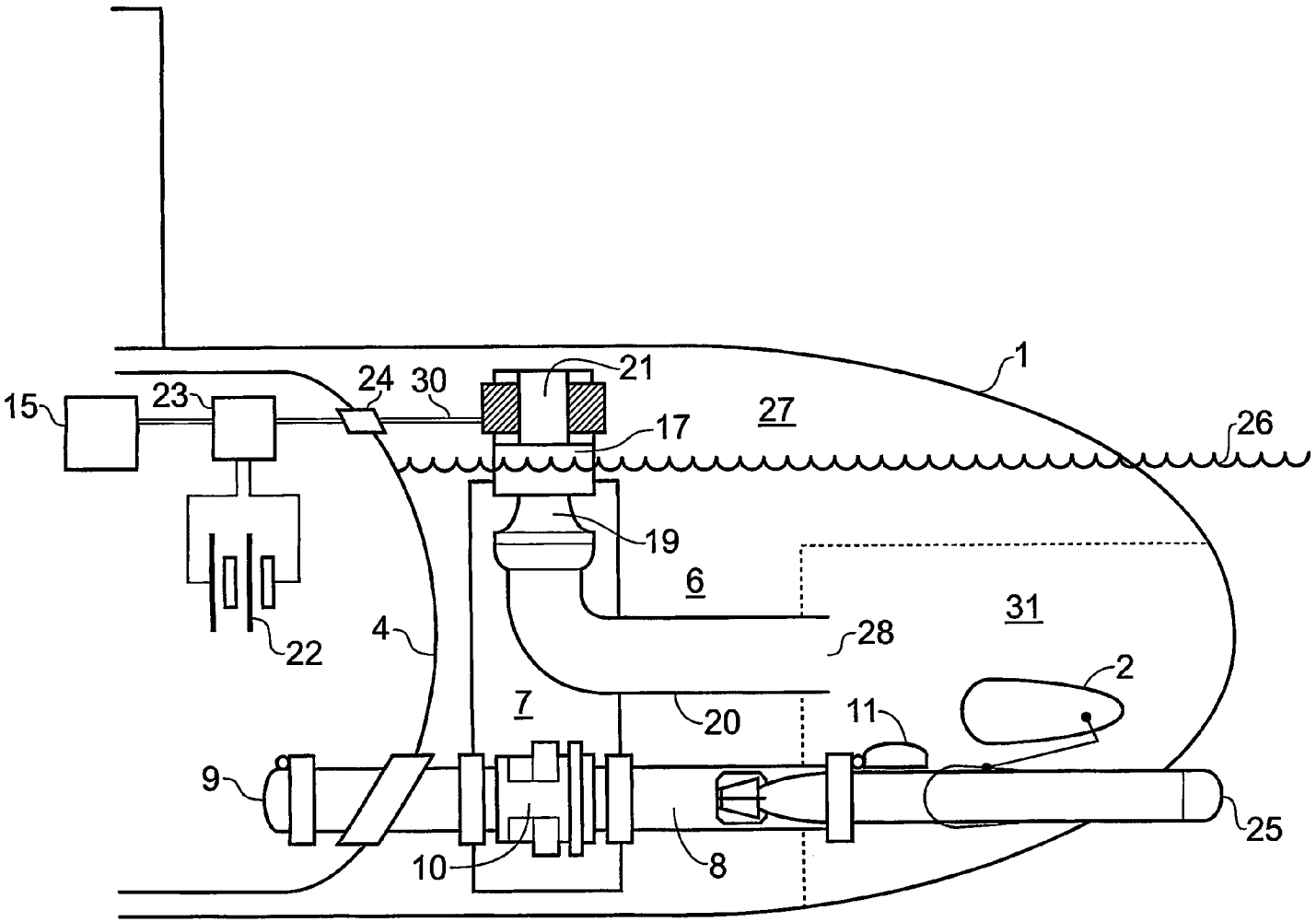
FIG. 3 shows the layout of an electrically driven torpedo launching system, being a second embodiment of the present invention.

FIG. 3 illustrates a second embodiment of the present invention, again being a torpedo launching system. The embodiment of FIG. 3 is generally similar to that of FIG. 2, and again reference numerals used to indicate corresponding parts.

However, in the embodiment of FIG. 3, the motor unit 21 is not in the impulse tank 7. Instead, it is mounted above it. The motor unit 21 is still between the pressure hull 4 and the outer casing 1 of the submarine, and the cables 30 again pass through a gland 24 to reach the power supply 22 for the motor. Moreover, in this arrangement, since the motor 21 is above the impulse tank 7, it is convenient if the impeller 19 is at the top of the impulse tank 17, adjacent the motor 21, and therefore the torpedo tube 8 extends through the impulse tank 7 near the bottom thereof.

The positioning of the motor unit 21 above the impulse tank 7 has the advantage that the motor unit 21 is readily accessible for maintenance, installation or removal. Moreover, when the submarine floats, although the space between the casing 1 and the pressure hull contains water the surface 26 of the water in which the submarine is floating fills that space only part-way up the casing 1, so that there is an air space 27 above that surface 26. Since the motor unit 21 is located in that air space 27, it can be accessed above the surface of the water. Thus, the motor unit 21 is accessible for maintenance with the submarine floating, rather than in dry dock. This is an advantage compared with the arrangement of FIG. 2, where it would probably be necessary for the submarine to be in dry dock for maintenance of the motor unit 21.

It should be noted that when the submarine is submersed, there is no longer and air space 27 and the motor 21 is submerged in water. This means that it will be cooled during operation.

FIG. 3 illustrates another variation from the embodiment of FIG. 2, in that the water inlet tube does not extend to an inlet orifice in the casing 1, but instead to an orifice 28 leading to a bow shutter volume 31 within the casing 1. The bow shutter volume 31 is within the casing, but is flooded with water and thus water can be pumped from that space 31 via the inlet tube 20 to the impeller 19.

Other features of this embodiment are similar to the second embodiment of the FIG. 2, and therefore will not be described in detail. However, it should be noted that FIG. 3 shows an arrangement in which the valve shutter 2 is displaced from the outlet of the torpedo tube 8.

The embodiments of the present invention discussed above illustrate a torpedo launching system in a submarine. However, the present invention is not limited to this and the launching system may be used on other marine vessels. Moreover, payloads other than torpedoes may be launched by embodiments of the present invention.

The invention claimed is:

1. A marine vessel having a payload launch system, the vessel having an outer casing and a pressure hull inside the outer casing, the payload launch system having at least one payload launch tube, an impulse tank for fluid, the impulse tank having an inlet for entry of fluid into the impulse tank and an outlet communicating with the launch tube, and an impeller inside the impulse tank for pressurizing fluid in the impulse tank so as to deliver pressurized fluid to the launch tube via the outlet of the impulse tank to launch a payload from the launch tube; characterized in that: an electric motor unit is connected to the impeller to drive the impeller, with the impulse tank and the motor being between the pressure hull and the casing.

2. A marine vessel according to claim 1, wherein the impulse tank of the launching system is within the outer casing but spaced from the pressure hull.

3. A marine vessel according to claim 1, wherein a power supply for said motor unit is located within the pressure hull and is connected to the motor unit by cables passing through the pressure hull.

4. A marine vessel according to claim 1, wherein the launch tube extends through the impulse tank and through the pressure hull.

5. A marine vessel according to claim 1, wherein the launch tube extends into the impulse tank, the outlet of the impulse tank being in a wall of the launch tube within the impulse tank.

6. A marine vessel according to claim 1, wherein the motor unit is disposed in the impulse tank.

7. A marine vessel according to claim 1, wherein the motor unit is situated above the impulse tank.

8. A marine vessel according to claim 1, wherein the impeller is a centrifugal impeller.

9. A marine vessel according to claim 1, wherein the motor unit is a high torque motor.

10. A marine vessel according to claim 1, wherein the vessel is a submarine.

* * * * *